US007560656B2

(12) United States Patent
Okatani et al.

(10) Patent No.: US 7,560,656 B2
(45) Date of Patent: Jul. 14, 2009

(54) SWITCH DEVICE WITH RAPID OPENING AND CLOSING BETWEEN MOVABLE AND STATIONARY CONTACTS

(75) Inventors: Shoji Okatani, Saitama (JP); Hirokazu Nakata, Saitama (JP)

(73) Assignee: Toyo Denso Co. Ltd, Tokyo (JP)

( * ) Notice: Subject to any disclaimer, the term of this patent is extended or adjusted under 35 U.S.C. 154(b) by 0 days.

(21) Appl. No.: 11/889,200

(22) Filed: Aug. 9, 2007

(65) Prior Publication Data

US 2008/0047820 A1 Feb. 28, 2008

(51) Int. Cl.
*H01H 21/00* (2006.01)

(52) U.S. Cl. ..... 200/559; 200/339

(58) Field of Classification Search ..... 200/559
See application file for complete search history.

(56) References Cited

U.S. PATENT DOCUMENTS 3,529,109 A * 9/1970 Cross ..... 200/557
6,504,116 B2 * 1/2003 Nishikawa ..... 200/6 B
7,115,826 B2 * 10/2006 Sasaki ..... 200/339
7,132,616 B1 * 11/2006 Radosavljevic et al. ..... 200/553
2003/0159912 A1 * 8/2003 Sasaki ..... 200/553

FOREIGN PATENT DOCUMENTS

JP 9-323682 A 12/1997

* cited by examiner

*Primary Examiner*—Lincoln Donovan
*Assistant Examiner*—Lheiren Mae A Anglo
(74) *Attorney, Agent, or Firm*—Arent Fox LLP.

(57) ABSTRACT

A control knob is supported on a switch base via a first pivotal shaft. A movable contact holder holds a movable contact, faces an inner side face of the control knob, and is supported on the switch base via a second pivotal shaft. The movable contact holder is provided with a sliding surface which faces the control knob. A control plunger whose tip end slidably abuts on the sliding surface is fitted to the control knob so as to be slidable in a direction perpendicular to an axis of the first pivotal shaft. A spring is provided between the control knob and the control plunger so as to urge the control plunger to a direction to but on the sliding surface. The movable contact is attached to the movable contact holder so as to come into contact with the stationary contact when the movable contact holder is turned to at least one of first and second actuation positions. Thus, it is possible to provide a switch which enables a rapid opening and closing between a movable contact and a stationary contact by imparting a snap action to the movable contact.

9 Claims, 8 Drawing Sheets

TURNED-OFF STATE

TURNED-ON STATE

SWITCH DEVICE WITH RAPID OPENING AND CLOSING BETWEEN MOVABLE AND STATIONARY CONTACTS

BACKGROUND OF THE INVENTION

1. Field of the Invention

The present invention relates to an improvement of a switch, comprising: a switch base; a stationary contact fixed to the switch base; a control knob attached to the switch base so as to be movable between a first operating position and a second operating position; a movable contact holder which is movable in association with the movement of the control knob to the first and second operation positions; and a movable contact which is supported by the movable contact holder and comes into and out of contact with the stationary contact in response to the movement of the movable contact holder.

2. Description of the Related Art

Such a switch has been already known as disclosed in Japanese Patent Application Laid-open No. 9-323682.

In the conventional switch, movable contacts are of a sliding type. It is desirable that the speed of the movable contact in coming into and out of contact with the stationary contact is as high as possible to improve the durability of the contact. In the conventional switch, however, the speed in question relies on the operation speed of the control knob.

SUMMARY OF THE INVENTION

The present invention has been achieved in view of such circumstances, and an object thereof is to provide a switch which enables a rapid opening and closing between a movable contact and a stationary contact, by imparting a snap action to the movable contact regardless of the operation speed of the control knob.

To achieve the above-mentioned object, according to a first feature of the invention, there is provided a switch, comprising: a switch base; a stationary contact fixed to the switch base; a control knob attached to the switch base so as to be movable between a first operating position and a second operating position; a movable contact holder which is movable in association with the movement of the control knob to the first and second operation positions; and a movable contact which is supported by the movable contact holder and comes into and out of contact with the stationary contact in response to the movement of the movable contact holder, wherein the control knob is supported on the switch base via a first pivotal shaft so as to be tiltable between the first and second operating positions; wherein the movable contact holder holds the movable contact, faces an inner side face of the control knob, and is supported on the switch base, via a second pivotal shaft substantially parallel with the first pivotal shaft, so as to tilt between a first and second actuation positions; wherein the movable contact holder is provided with a sliding surface which faces the control knob; wherein a control plunger whose tip end slidably abuts on the sliding surface is fitted to the control knob so as to be slidable in a direction perpendicular to an axis of the first pivotal shaft; wherein the control plunger is urged by a spring in a direction to abut on the sliding surface; and wherein the movable contact is attached to the movable contact holder so as to come into contact with the stationary contact when the movable contact holder is turned to at least one of the first and second actuation positions.

With the first feature of the present invention, the control plunger is urged in the direction to abut on the sliding surface by the urging force of the control spring, so that the movable contact holder is rapidly tilted about the second pivotal shaft to the side to which the tip end of the control plunger proceeds every time the tip end of the control plunger crosses from one side to the other side of the plane extending between the axes of the first and second pivotal shafts. Therefore, when the movable contact holder rapidly turns to the first actuation position, the movable contact is brought into contact with the stationary contact with an impact, thereby effectively removing interjacent objects such as oxide film and dust from between the contact portions, and minimizing generation of sparks. Thus, it is possible to bring the switch into a desirable turned-on state regardless of the operation speed of the control knob. Also, when the movable contact holder is rapidly turned to the second actuation position, the movable contact is rapidly separated from the stationary contact, thereby bringing the switch into a desirable turned-off state regardless of the operation speed of the control knob. With this arrangement, the durability of the switch is improved.

Further, in a non-contact state between the stationary contact and the movable contact, only a space exists between the contacts, and thus waterdrops such as rainwater drops cannot reside between the contacts. Therefore, it is possible to avoid a short-circuit failure due to the waterdrops residing between the contacts. In this structure, the gap between the contacts in a non-contact state can be sufficiently decreased as compared with the case of a movable-contact sliding type, thereby downsizing the switch.

According to a second feature of the present invention, in addition to the first feature, the movable contact has an elastic contact piece which comes into contact with the stationary contact to be bent when the movable contact holder reaches the one of the actuation positions.

With the second feature, as the movable contact turns to one of the actuation positions of the movable contact holder, the contact part of the elastic contact piece of the movable contact is brought into contact with an impact with the stationary contact and at the same time the elastic contact piece is bent, thereby giving a strong impact and friction between the contact portions between the stationary contact and the movable contact. Therefore, it is possible to effectively remove interjacent objects such as oxide film and dust from between the contact portions, and minimize generation of sparks. Also, in a state in which the movable contact holder is kept at one of the actuation position, the elastic contact piece of the movable contact bends while abutting on the stationary contact. Therefore, the contact pressure between the movable contact and the stationary contact is determined not by the strong urging force of the spring, but by the repulsive force due to the bending of the elastic contact piece. Thus, it is possible to prevent the contact pressure by the elastic contact piece from becoming excessive, thereby contributing to improvement of the durability of the contacts.

The above and other objects, features and advantages of the invention will become apparent from the following description of the preferred embodiment taken in conjunction with the accompanying drawings.

DESCRIPTION OF THE PREFERRED EMBODIMENT

Figure 1:
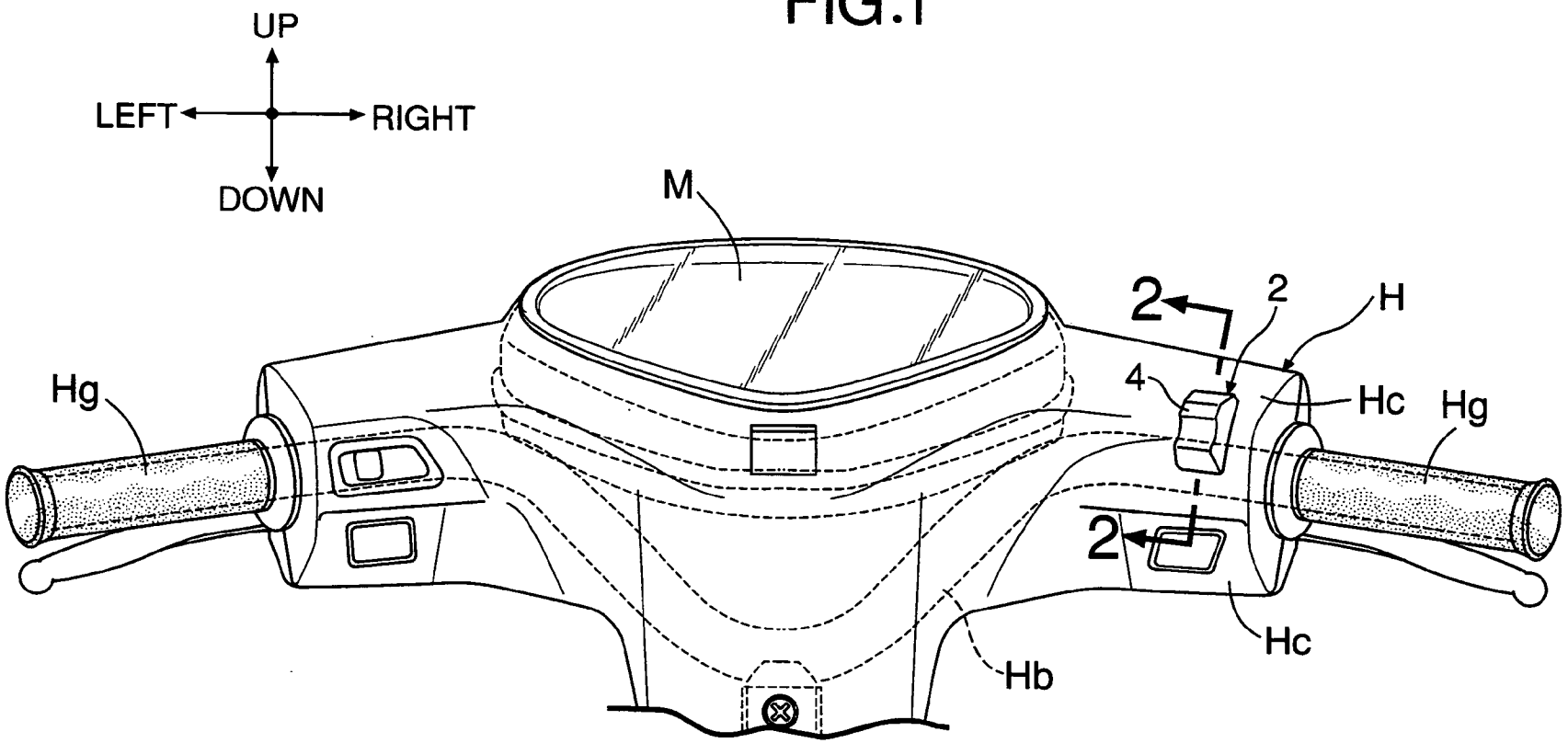
FIG. 1 is a rear view showing a steering handle system for a motorcycle including a switch according to an embodiment of the present invention.
Figure 2:
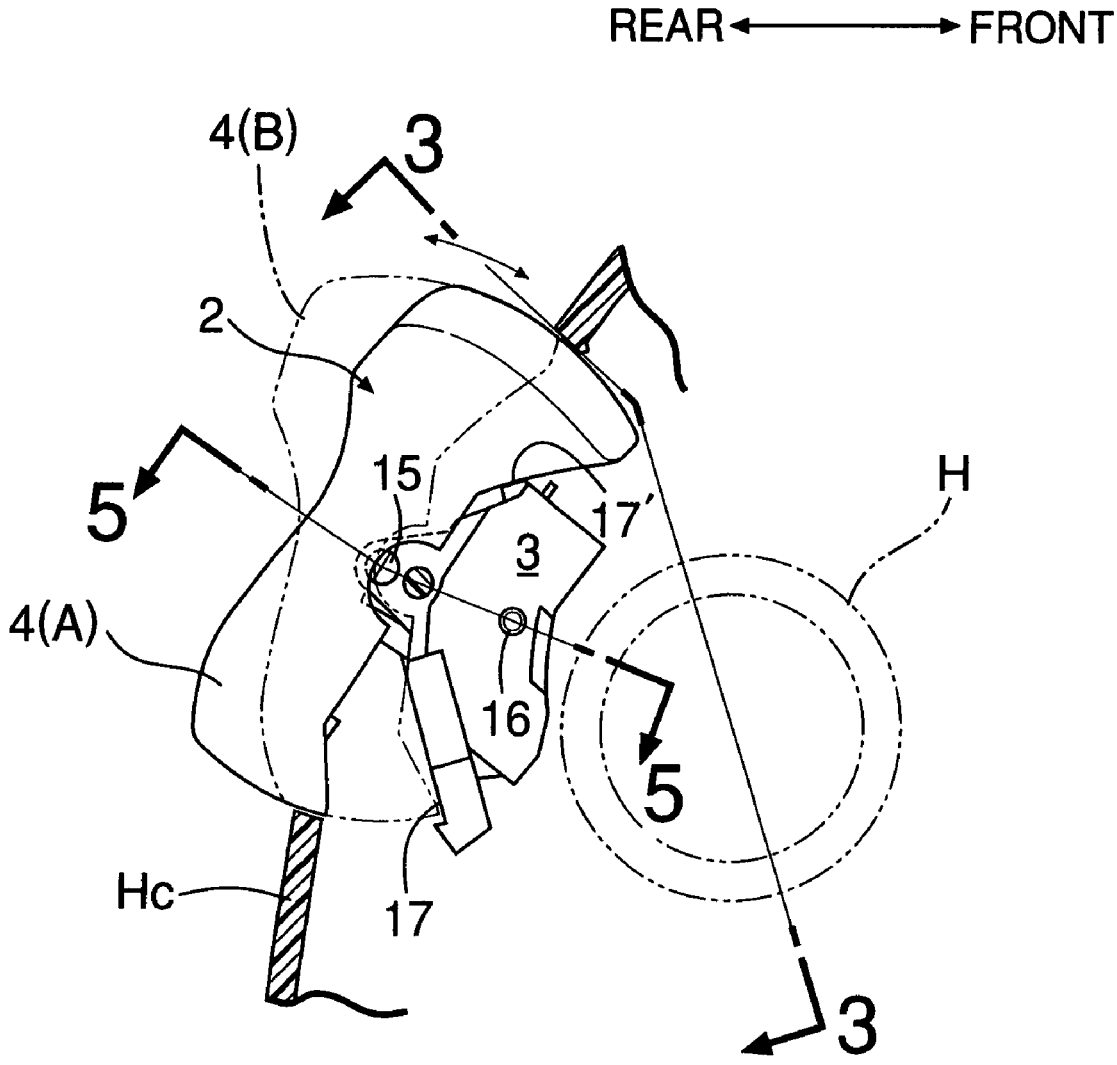
FIG. 2 is a sectional view taken along line 2-2 in FIG. 1.
Figure 3:
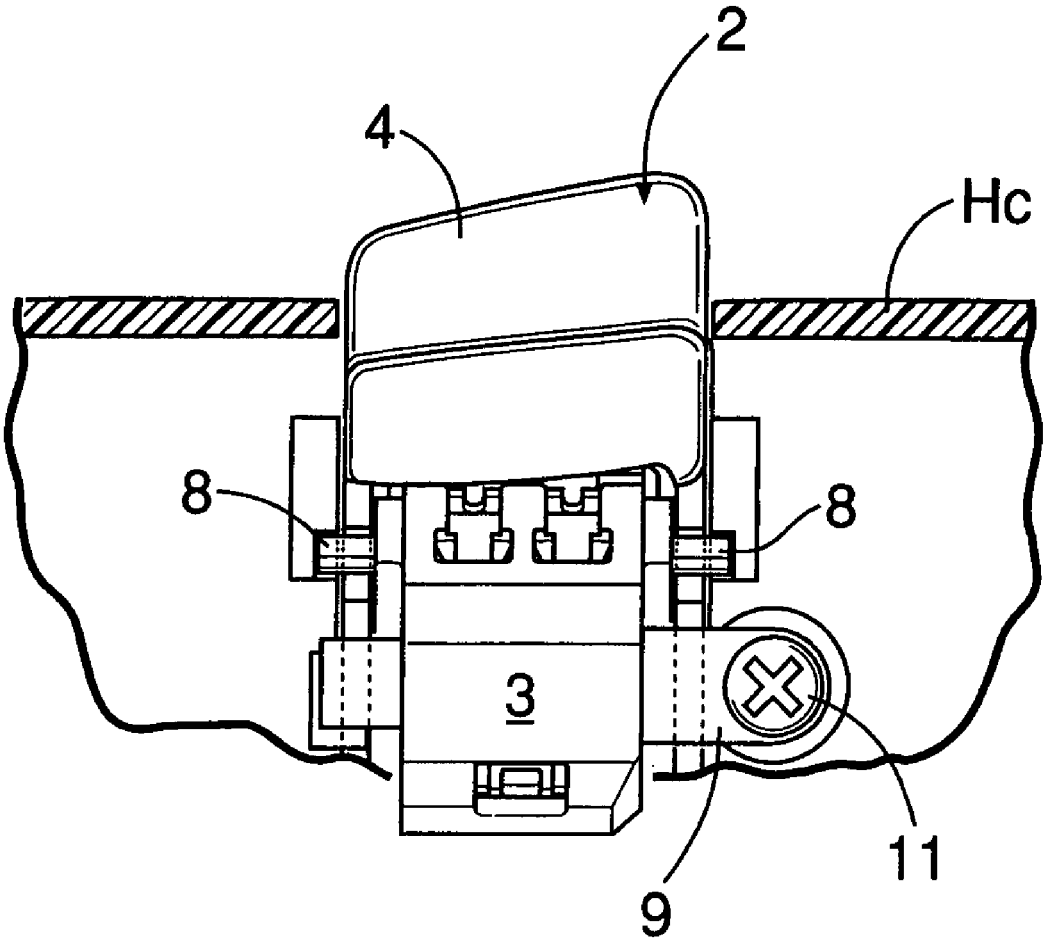
FIG. 3 is a sectional view taken along line 3-3 in FIG. 2.
Figure 4:
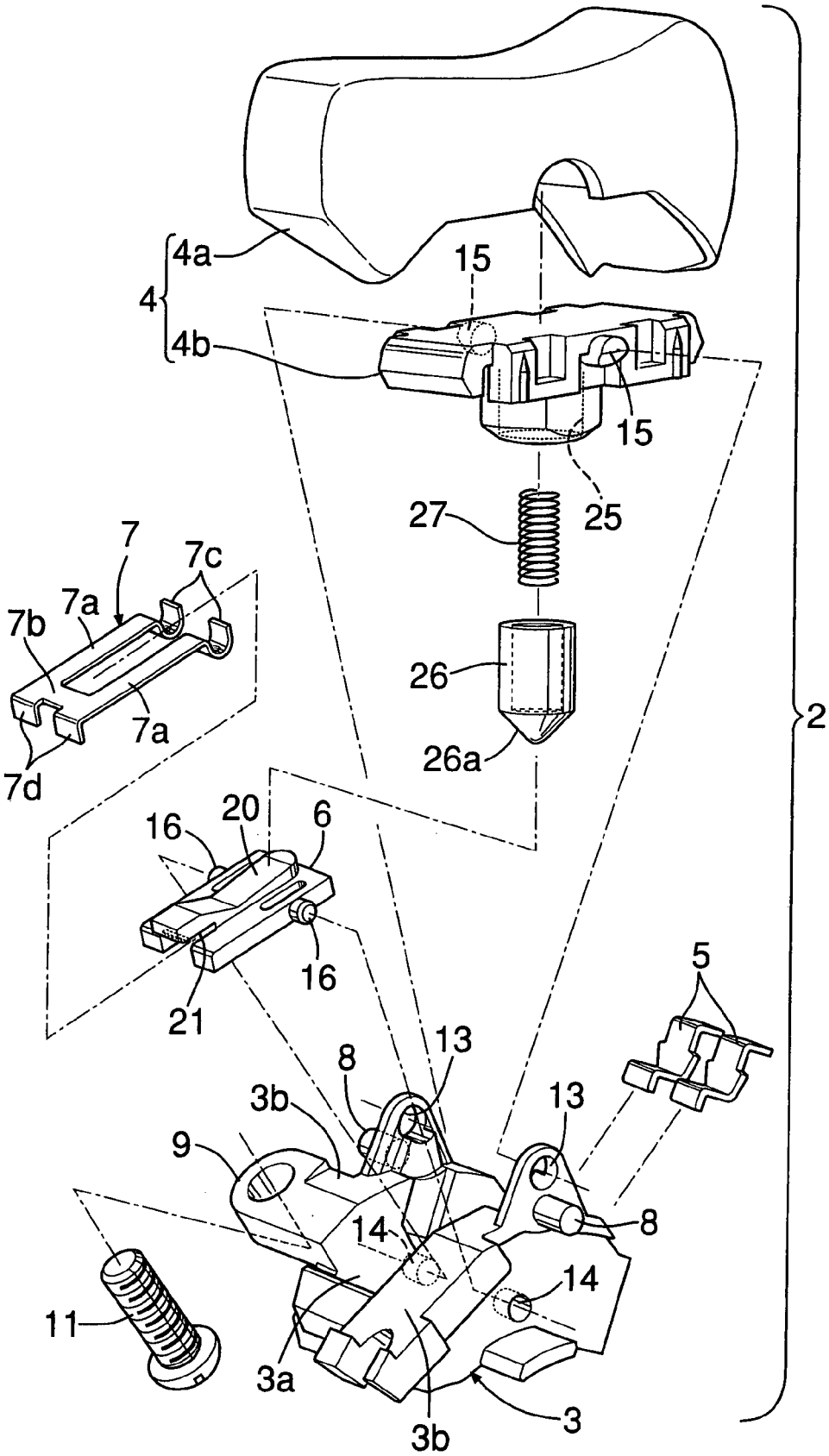
FIG. 4 is an exploded perspective view of the switch.

First, in FIG. 1, a steering handle system H for a motorcycle comprises a handle bar Hb and a handle cover Hc. The handle bar Hb is connected to an upper end of a front fork not shown, and has grips Hg at its opposite end. The handle cover Hc covers an intermediate portion of the handle bar Hb except for the grips Hg. The handle cover Hc is secured by screws to the handle bar Hb at an appropriate position. Various switches are attached to a rear wall, facing the driver, of the handle cover Hc. An engine kill-switch 2 to which the present invention is applied is attached to an upper part of a right end part of the handle cover Hc. A meter unit M including a combination of various meters is attached to an upper part of the handle cover Hc.

In FIGS. 2 to 6, the kill-switch 2 includes major components: a switch base 3 fixed to the handle cover Hc; a control knob 4; a pair of left and right stationary contacts 5, 5; a movable contact holder 6; and a movable contact 7.

The switch base 3 is made of synthetic resin, and has a groove 3*a* and a pair of sidewalls 3*b*, 3*b* aligned side by side with the groove 3*a* therebetween. The pair of left and right stationary contacts 5, 5 are secured to the bottom face of the groove 3*a*.

Figure 5:
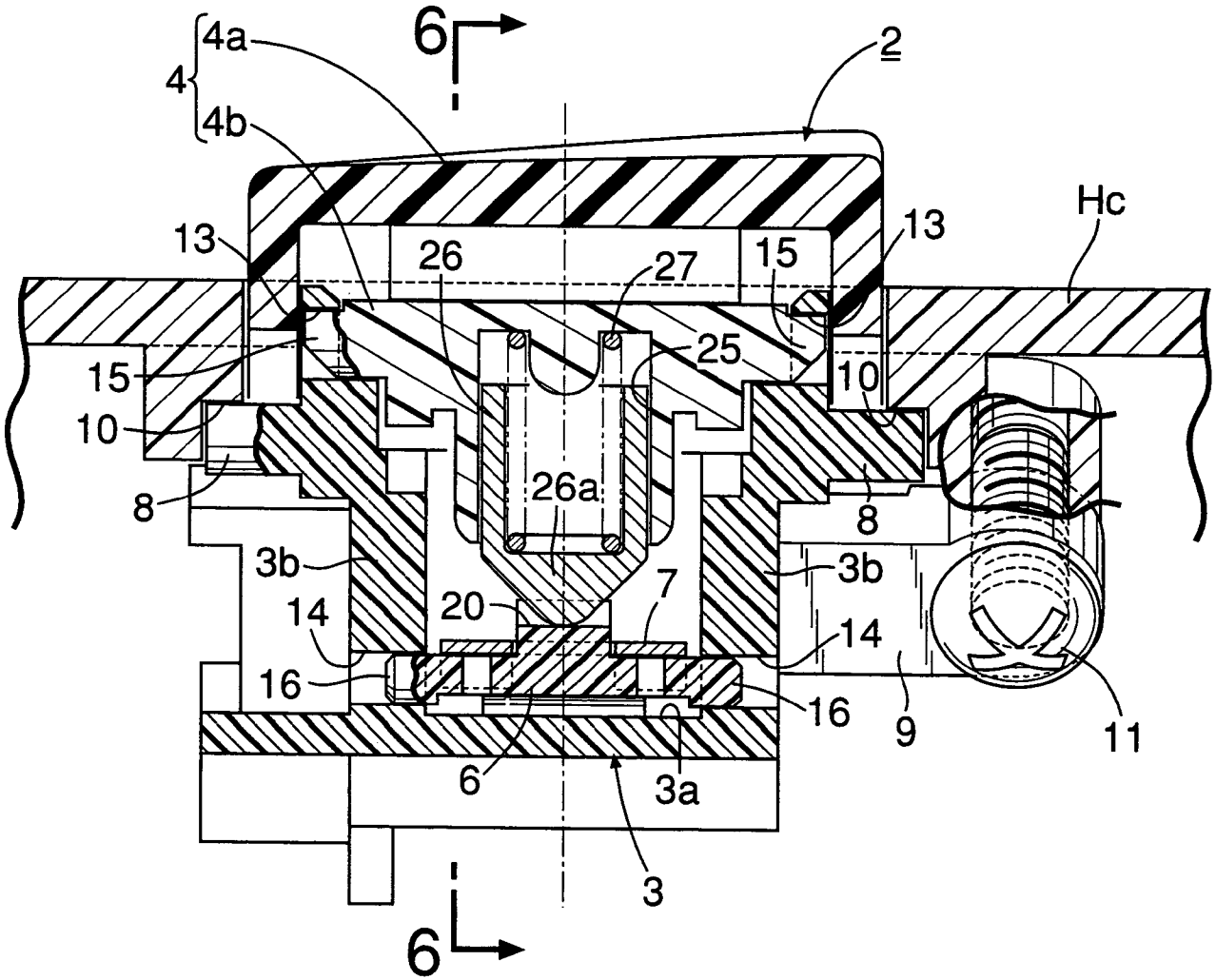
FIG. 5 is a sectional view taken along line 5-5 in FIG. 2.

As shown in FIG. 5, positioning protrusions 8, 8 are formed in outer side faces of the left and right sidewalls 3*b*, 3*b*, and a stay 9 is formed in an outer side face of one of the sidewalls 3*b*. The positioning protrusions 8, 8 are engaged into positioning grooves 10, 10 of an inner wall of the handle cover Hc, and then the stay 9 is secured to the inner wall of the handle cover Hc with a screw 11, thereby fixing the switch base 3 to the handle cover Hc.

A pair of coaxially aligned first shaft support holes 13, 13 are provided at tip ends of the left and right sidewalls 3*b*, 3*b*. A coaxially aligned pair of second shaft support holes 14, 14 are provided in the sidewalls 3*b*, 3*b* at portions in the vicinity of the bottom face of the groove 3*a* so as to be parallel with the first shaft support holes 13, 13. A pair of first pivotal shafts 15, 15, which protrude from the left and right side faces of the control knob 4, are rotatably fitted into the first shaft support holes 13, 13, respectively. A pair of second pivotal shafts 16, 16, which protrude from the left and right side faces of the movable contact holder 6, are rotatably fitted into the second shaft support holes 14, 14, respectively.

Figure 6:
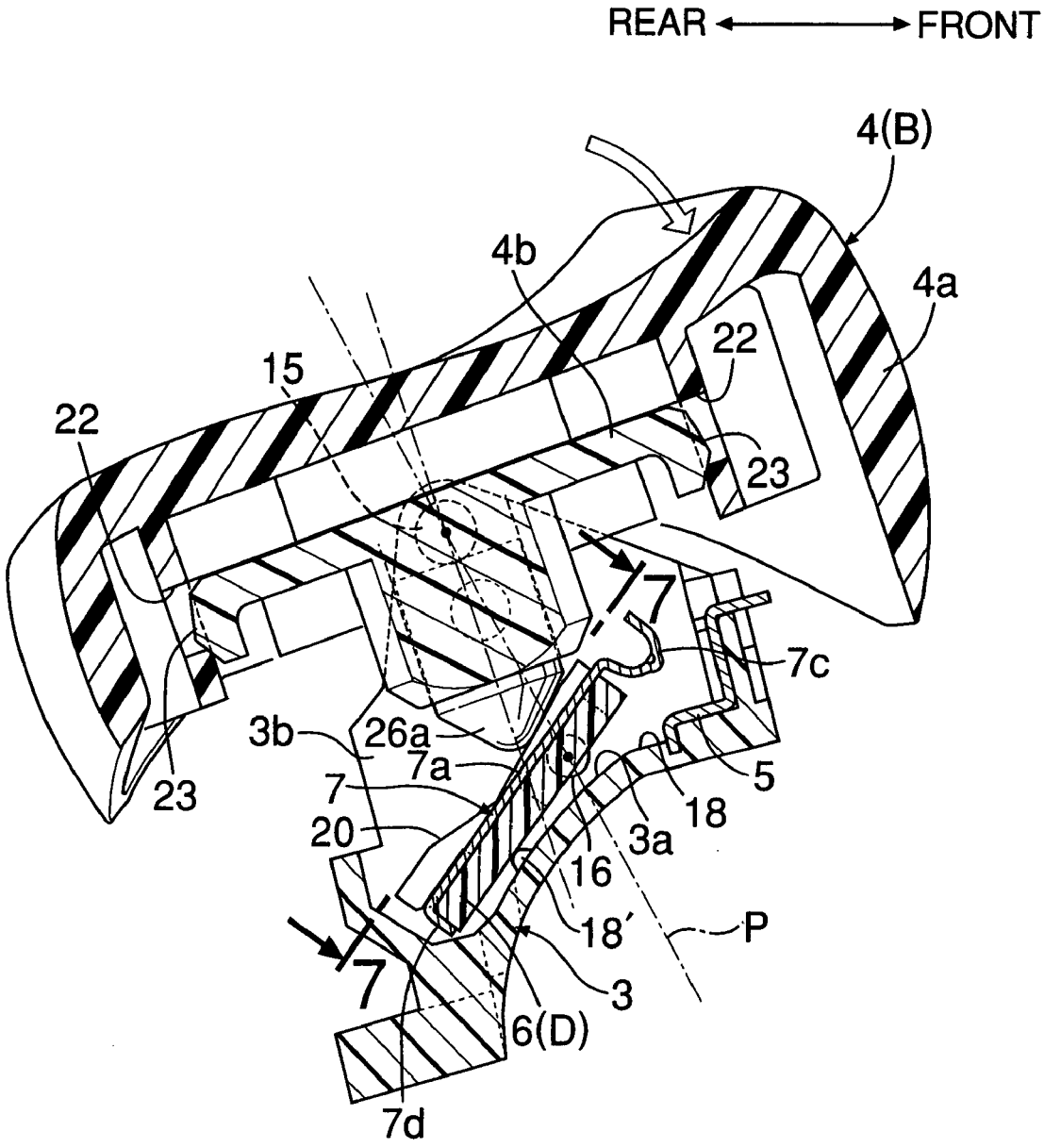
FIG. 6 is a sectional view taken along line 6-6 in FIG. 5, showing a turned-off state of the switch.
Figure 8:
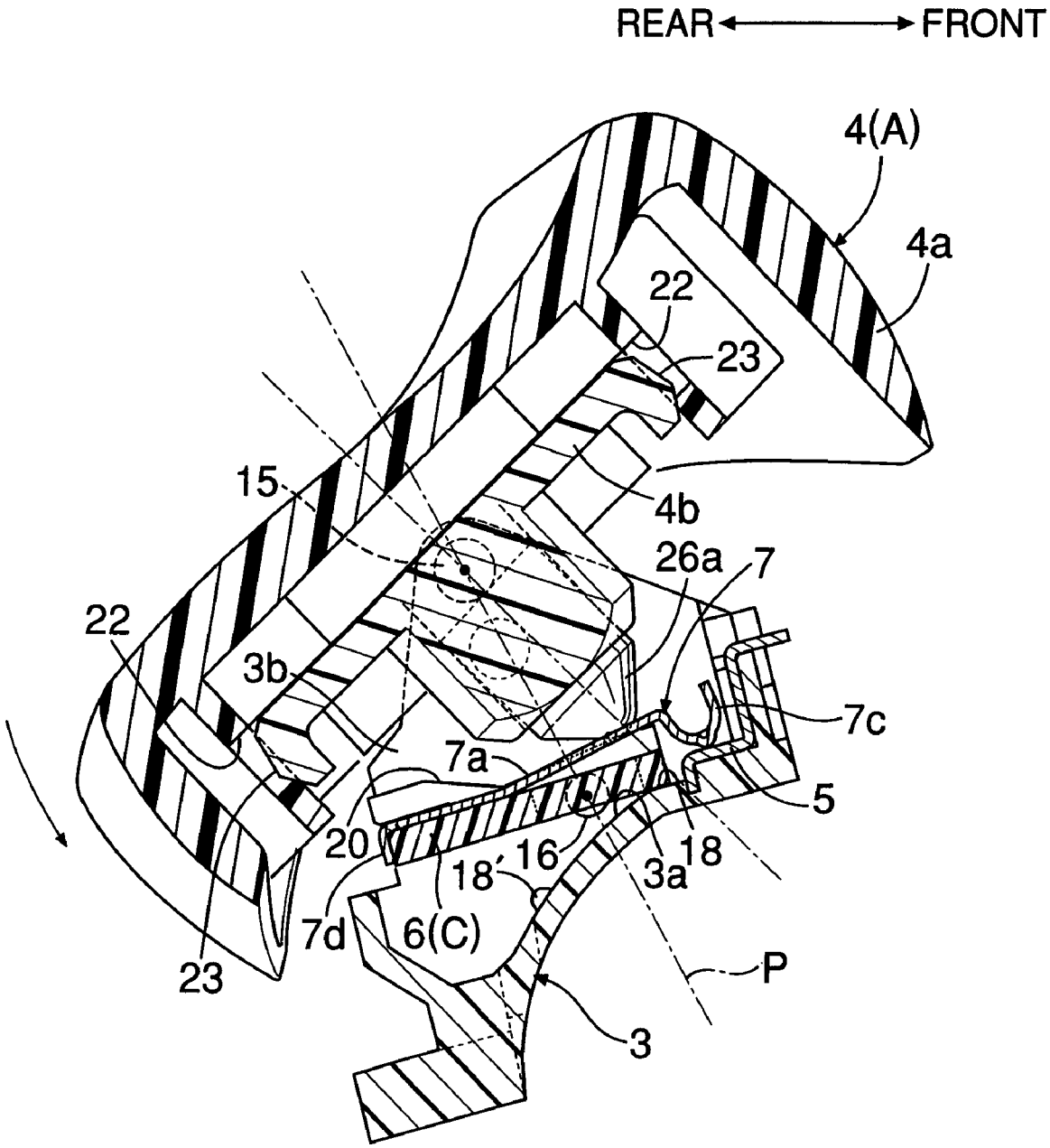
FIG. 8 is a view corresponding to FIG. 6 and showing a turned-on state of the switch.

As shown in FIGS. 6 and 8, the control knob 4 is tiltable about the first pivotal shafts 15, 15 between a first operating position A (see FIG. 8) and a second operating position B (see FIG. 6). The first and second operating positions A, B are defined by the lower face of the control knob 4 alternately abutting on first and second stoppers 17, 17' (see FIG. 2) formed in the switch base 3. The movable contact holder 6 is tiltable about the second pivotal shafts 16, 16 between a first actuation position C (see FIG. 8) and a second actuation position D (see FIG. 6). The first and second actuating positions C, D are defined by the lower face of the movable contact holder 6 alternately abutting on third and fourth stoppers 18, 18' formed in the bottom face of the groove 3*a*.

Figure 7:
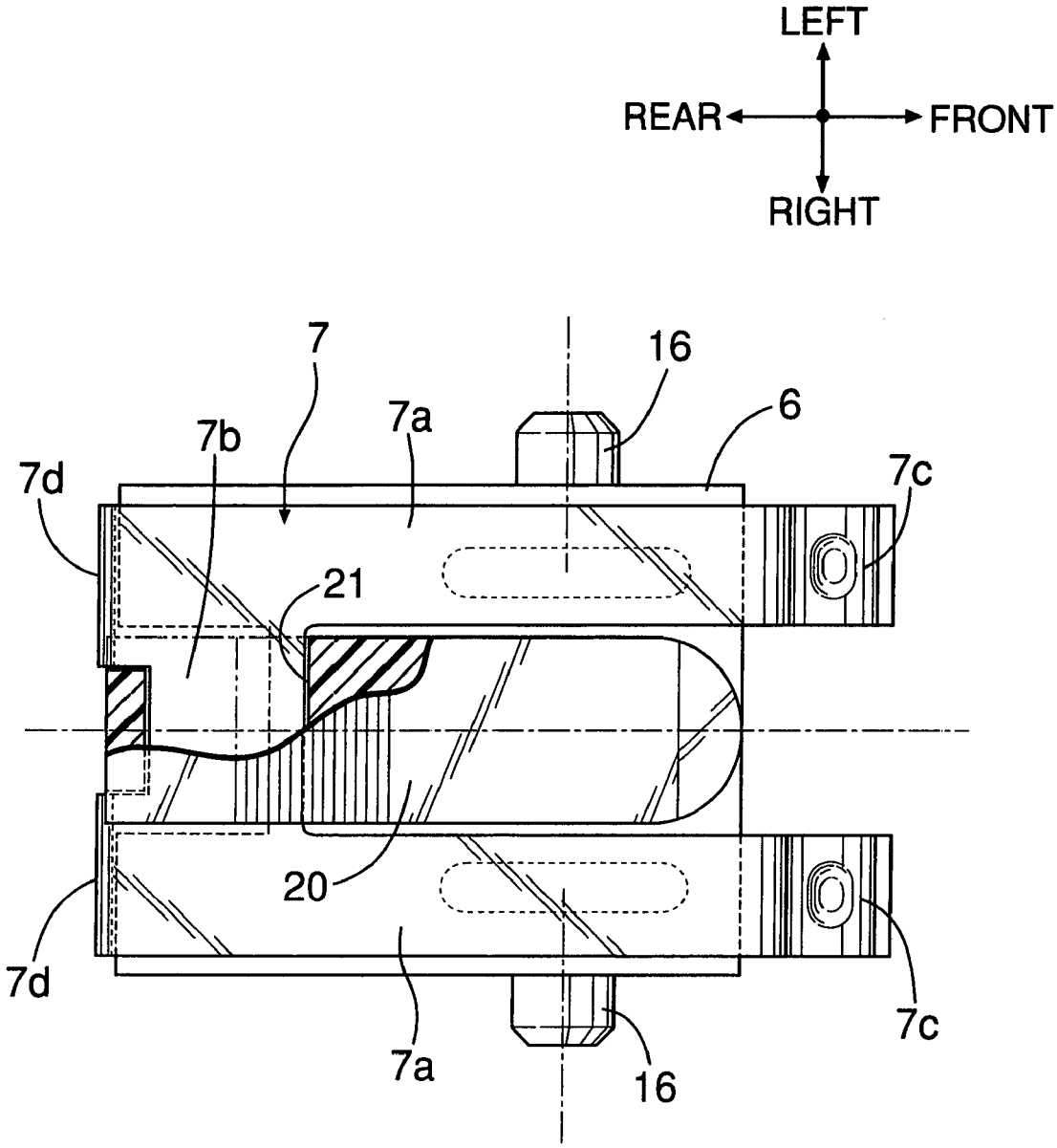
FIG. 7 is a sectional view taken along line 7-7 in FIG. 6.

As shown in FIG. 7, the movable contact 7 is attached to the movable contact holder 6. The movable contact 7 comprises a pair of left and right elastic contact pieces 7*a*, 7*a*, and a connecting piece 7*b* integrally connecting together intermediate portions of the elastic contact pieces 7*a*, 7*a*. U-shaped contact parts 7*c*, 7*c* are formed at tip ends of the elastic contact pieces 7*a*, 7*a*. Positioning parts 7*d*, 7*d* which bend downward are formed at rear ends of the elastic contact pieces 7*a*, 7*a*, respectively. The movable contact 7 is held at a predetermined position in the movable contact holder 6, by press-fitting the connecting piece 7*b* into the engaging groove 21 of the movable contact holder 6 and causing the positioning parts 7*d*, 7*d* to abut on a rear end of the movable contact holder 6. In the movable contact 7, when the movable contact holder 6 turns to the first actuation position C, the contact parts 7*c*, 7*c* is brought into abutment on the stationary contacts 5, 5 before the movable contact holder 6 reaches the first actuation position C. Therefore, when the movable contact holder 6 reaches the first actuation position C, the elastic contact pieces 7*a*, 7*a* are bent because the contact parts 7*c*, 7*c* has already abutted on the stationary contacts 5, 5. Also, in the movable contact 7, when the movable contact holder 6 turns to the second actuation position D, the contact parts 7*c*, 7*c* are separated from the stationary contacts 5, 5. Formed on an upper face of the movable contact holder 6 is a sliding surface 20 expanding into a V-shape in a direction perpendicular to the axis of the second pivotal shafts 16, 16.

On the other hand, the control knob 4 comprises: a synthetic resin knob outer part 4*a* having a box shape with its lower face opened; and a synthetic resin knob inner part 4*b* fitted into the knob outer part 4*a*. A pair of engaging holes 22, 22 are formed in the left and right inner sidewalls of the knob outer part 4*a*. The knob outer part 4*a* and the knob inner part 4*b* are separably connected to each other such that a pair of engaging protrusions 23, 23 integrally formed on the left and right side faces are engaged into the engaging holes 22, 22. With this arrangement, mere change of the knob outer part 4*a* can provide switches corresponding to vehicle types and other factors without changing the major part of the kill-switch 2, thereby improving the productivity.

The first pivotal shafts 15, 15 are projectingly integrally formed on the side faces of the knob inner part 4*b*. A bottomed guide hole 25 is provided in the knob inner part 4*b* so as to extend in a direction perpendicular to the axis of the first pivotal shafts 15, 15 and open in the lower face of the knob inner part 4*b*. A control plunger 26 is fitted into the guide hole 25 so as to cause its tip end 26*a* to slide on the sliding surface 20. A control spring 27 is housed in the guide hole 25 so as to urge the control plunger 26 in a direction to abut on the sliding surface 20. The tip end 26*a* of the control plunger 26 is formed into a conical shape having a hemisphere top.

Next, the operation of the embodiment will be described.

As shown in FIGS. 6 and 8, as the control knob 4 is tilted forward and rearward about the first pivotal shafts 15, 15, the tip end 26*a* of the control plunger 26 slides forward and rearward on the sliding surface 20 of the movable contact holder 6 between one side and the other side of the plane P extending between the axes of the first and second pivotal shafts 15 and 16.

Because the control plunger 26 is slidably fitted into the guide hole 25 of the control knob 4, and is urged in the direction to abut on the sliding surface 20 by the urging force of the control spring 27, the movable contact holder 6 is rapidly tilted about the second pivotal shafts 16, 16 to the side to which the tip end 26*a* of the control plunger 26 proceeds every time the tip end 26*a* passes through the plane P.

Specifically, as shown in FIG. 8, if the control knob 4 is tilted rearward, that is, to the first operating position A, the tip end 26*a* of the control plunger 26 slides on the sliding surface 20 toward the stationary contacts 5, 5, and the movable contact holder 6 is rapidly tilted to the first actuation position C. Accordingly, in the movable contact 7, the contact parts 7*c*, 7*c* of the elastic contact pieces 7*a*, 7*a* are brought into contact with an impact with the stationary contacts 5, 5 and the elastic contact pieces 7*a*, 7*a* are bent, thereby bringing the kill-switch 2 into the turned-on state. In this way, the contact parts 7*c*, 7*c* of the elastic contact pieces 7*a*, 7*a* are brought into contact with an impact with the stationary contacts 5, 5, and at the same time the elastic contact pieces 7*a*, 7*a* are bent, so that a strong impact and friction are given to the contact portions between the stationary contacts 5, 5 and the movable contact 7, thereby effectively removing interjacent objects such as oxide film and dust from between the contact portions, and minimize generation of sparks. Therefore, it is possible to bring the kill-switch 2 into an excellent turned-on state regardless of the operation speed of the control knob 4. Also, in a state in which the movable contact holder 6 is held at the first actuation position C by the urging force of the control spring 27, the elastic contact pieces 7*a*, 7*a* of the movable contact 7 are bent with the contact parts 7*c*, 7*c* in abutment on the stationary contacts 5, 5 as described above. Therefore, the contact pressure between the movable contact 7 and the stationary contacts 5, 5 is determined not by the strong urging force of the control spring 27, but by the repulsive force due to the bending of the elastic contact pieces 7*a*, 7*a*. Thus, it is possible to prevent the contact pressure from becoming excessive, thereby contributing to the improvement of the durability of the contacts 7 and 5.

On the other hand, if the control knob 4 is tilted forward, that is, to the second operating position B, the tip end 26*a* of the control plunger 26 slides on the sliding surface 20 in a direction away from the stationary contacts 5, 5, and the movable contact holder 6 is rapidly reversely tilted to the second actuation position D. Accordingly, the movable contact 7 is rapidly separated from the stationary contacts 5, 5, thereby suppressing the generation of sparks. Therefore, likewise in this case, it is possible to bring the kill-switch 2 into an excellent turned-off state regardless of the operation speed of the control knob 4.

Further, in a turned-off state of the kill-switch 2, that is, in a non-contact state of the stationary contacts 5, 5 and the movable contact 7, only a space exists between the contacts 5 and 7, and thus waterdrops such as rainwater drops cannot reside therebetween. Therefore, it is possible to avoid a short-circuit failure due to the waterdrops residing between the contacts 5 and 7. In this structure, the gap between the contacts 5 and 7 in a non-contact state can be sufficiently decreased as compared with the case of a movable-contact sliding type, thereby downsizing the switch 2.

The present invention is not limited to the above described embodiment, and changes in design can be made without departing from the subject matter of the present invention. For example, the operating direction of the control knob 4 can be any direction such as leftward and rightward, upward and downward directions in addition to the forward and backward directions.

Also, the present invention is applicable to a change-over switch such as a dimmer switch without being limited to an open-close switch such as the above-described kill-switch 2.

What is claimed is:

1. A switch, comprising:

a switch base;

a stationary contact fixed to the switch base;

a control knob attached to the switch base so as to be movable between a first operating position and a second operating position;

a movable contact holder which is movable in association with the movement of the control knob to the first and second operation positions; and a movable contact which is formed separately from and supported by the movable contact holder and comes into and out of contact with the stationary contact in response to the movement of the movable contact holder, the movable contact comprising an L-shaped positioning part at a first end and a U-shaped contact part at a second end opposite the first end, the L-shaped positioning part abutting an end of the movable contact holder, wherein the control knob is supported on the switch base via a first pivotal shaft so as to be tiltable between the first and second operating positions;

wherein the movable contact holder holds the movable contact, faces an inner side face of the control knob, and is supported on the switch base, via a second pivotal shaft substantially parallel with and apart from the first pivotal shaft, so as to tilt between a first and second actuation positions;

wherein the movable contact holder is provided with a sliding surface which faces the control knob;

wherein a control plunger whose tip end slidably abuts on the sliding surface is fitted to the control knob so as to be slidable in a direction perpendicular to an axis of the first pivotal shaft;

wherein the control plunger is urged by a spring in a direction to abut on the sliding surface; and wherein the movable contact is attached to the movable contact holder so that the U-shaped contact part contacts the stationary contact when the movable contact holder is turned to at least one of the first and second actuation positions.

2. A switch according to claim 1, wherein the movable contact has an elastic contact piece the elastic contact piece which comes into contact with the stationary contact to be bent when the movable contact holder reaches the one of the actuation positions.

3. The switch according to claim 2, wherein the movable contact includes a connecting piece that joins the elastic contact piece to the L-shaped positioning part.

4. The switch according to claim 3, wherein the connecting piece of the movable contact is press-fit into a groove defined in the movable contact holder.

5. The switch according to claim 1, wherein the first end is a first axial end and the second end is a second axial end opposite the first axial end, and wherein the L-shaped positioning part of the movable contact is formed only at the first axial end and the U-shaped contact part of the movable contact is formed only at the second axial end.

6. A switch, comprising:

a switch base;

a stationary contact fixed to the switch base a control knob attached to the switch base so as to be movable between a first operating position and a second operating position;

a movable contact holder which is movable in association with the movement of the control knob to the first and second operation positions; and a movable contact which is formed separately from and supported by the movable contact holder and comes into and out of contact with the stationary contact in response to the movement of the movable contact holder, wherein the control knob is supported on the switch base via a first pivotal shaft so as to be tiltable between the first and second operating positions;

wherein the movable contact holder holds the movable contact, faces an inner side face of the control knob, and is supported on the switch base, via a second pivotal shaft substantially parallel with and apart from the first pivotal shaft, so as to tilt between a first and second actuation positions;

wherein the movable contact holder is provided with a sliding surface which faces the control knob;

wherein a control plunger whose tip end slidably abuts on the sliding surface is fitted to the control knob so as to be slidable in a direction perpendicular to an axis of the first pivotal shaft;

wherein the control plunger is urged by a spring in a direction to abut on the sliding surface; and wherein the movable contact is attached to the movable contact holder so as to come into contact with the stationary contact when the movable contact holder is turned to at least one of the first and second actuation positions.

7. The switch according to claim 6, wherein the movable contact has an elastic contact piece, the elastic contact piece which comes into contact with the stationary contact to be bent when the movable contact holder reaches the one of the actuation positions.

8. The switch according to claim 7, wherein the movable contact includes a connecting piece that joins the elastic contact piece to an L-shaped positioning part.

9. The switch according to claim 8, wherein the connecting piece of the movable contact is press-fit into a groove defined in the movable contact holder.

* * * * *

UNITED STATES PATENT AND TRADEMARK OFFICE

CERTIFICATE OF CORRECTION

PATENT NO. : 7,560,656 B2
APPLICATION NO. : 11/889200
DATED : July 14, 2009
INVENTOR(S) : Shoji Okatani and Hirokazu Nakata It is certified that error appears in the above-identified patent and that said Letters Patent is hereby corrected as shown below:

Title Page:

Item (30), insert the Foreign Application Priority Data to read:

-- August 10, 2006 (JP) .....2006-218365 --

Signed and Sealed this

Twentieth Day of October, 2009

David J. Kappos

David J. Kappos
*Director of the United States Patent and Trademark Office*